US005694110A

United States Patent [19]

Clifford

[11] Patent Number: 5,694,110

[45] Date of Patent: Dec. 2, 1997

[54] ILLUMINATED SIGNAL DEVICE

[76] Inventor: Tim Clifford, P.O. Box 184, Chino, Calif. 91708

[21] Appl. No.: 762,328

[22] Filed: Dec. 9, 1996

[51] Int. Cl.[6] ..... G08B 23/00

[52] U.S. Cl. ..... 340/321; 340/332; 340/908; 340/908.1; 40/586; 40/541; 116/63 P

[58] Field of Search ..... 340/321, 322, 340/331, 332, 908, 908.1; 40/540, 541, 586, 611, 615, 618, 574; 116/63 P

[56] References Cited

U.S. PATENT DOCUMENTS

| | | | |
|---|---|---|---|
| 1,121,249 | 12/1914 | Hirsch | 340/321 |
| 1,880,730 | 10/1932 | Bogue | 340/321 |
| 2,505,365 | 4/1950 | Roberts | 340/321 |
| 2,705,751 | 4/1955 | Harris et al. | 340/321 |
| 3,153,745 | 10/1964 | Gurian et al. | 340/321 |
| 3,435,412 | 3/1969 | Bohrer, Sr. | 340/908 |
| 4,253,415 | 3/1981 | Ferch | 340/908.1 |
| 4,717,991 | 1/1988 | Murphree, Jr. | 340/331 |
| 4,777,751 | 10/1988 | Pasquale | 340/908 |
| 5,276,424 | 1/1994 | Hegemann | 340/321 |
| 5,440,464 | 8/1995 | Nowlin et al. | 340/321 |

*Primary Examiner*—Jeffery Hofsass
*Assistant Examiner*—Nina Tong

[57] ABSTRACT

A signal device for alerting and informing surrounding persons. The inventive device includes a hand-held, illuminated signal assembly which can be manually manipulated to signal information to passing motorists. A power supply belt can be worn by a user and is electrically coupled to the signal assembly to provide electrical power needed for illumination thereof.

6 Claims, 4 Drawing Sheets

ILLUMINATED SIGNAL DEVICE

BACKGROUND OF THE INVENTION

1. Field of the Invention

The present invention relates to lighted sign structures and more particularly pertains to an illuminated signal device for alerting and informing surrounding persons.

2. Description of the Prior Art

The use of lighted sign structures is known in the prior art. More specifically, lighted sign structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art lighted sign structures include U.S. Pat. No. 5,276,424; U.S. Pat. No. 5,307,251; U.S. Pat. No. 5,313,188; U.S. Pat. No. 3,562,705; U.S. Pat. 5,319,365; and Design U.S. Pat. No. 351,807.

While these devices fulfill their respective, particular objectives and requirements, the aforementioned patents do not disclose an illuminated signal device for alerting and informing surrounding persons which includes a hand-held illuminated signal assembly which can be manually manipulated to signal information to passing motorists, and a power supply belt which can be worn by a user and is electrically coupled to the signal assembly to provide electrical power thereto.

In these respects, the illuminated signal device according to the present invention substantially departs from the conventional concepts and designs of the prior art, and in so doing provides an apparatus primarily developed for the purpose of alerting and informing surrounding persons.

SUMMARY OF THE INVENTION

In view of the foregoing disadvantages inherent in the known types of lighted sign structures now present in the prior art, the present invention provides a new illuminated signal device construction wherein the same can be utilized for signalling information to passing motorists. As such, the general purpose of the present invention, which will be described subsequently in greater detail, is to provide a new illuminated signal device apparatus and method which has many of the advantages of the lighted sign structures mentioned heretofore and many novel features that result in an illuminated signal device which is not anticipated, rendered obvious, suggested, or even implied by any of the prior art lighted sign structures, either alone or in any combination thereof.

To attain this, the present invention generally comprises a signal device for alerting and informing surrounding persons. The inventive device includes a hand-held, illuminated signal assembly which can be manually manipulated to signal information to passing motorists. A power supply belt can be worn by a user and is electrically coupled to the signal assembly to provide electrical power needed for illumination thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new illuminated signal device apparatus and method which has many of the advantages of the lighted sign structures mentioned heretofore and many novel features that result in an illuminated signal device which is not anticipated, rendered obvious, suggested, or even implied by any of the prior art tool guides, either alone or in any combination thereof.

It is another object of the present invention to provide a new illuminated signal device which may be easily and efficiently manufactured and marketed.

It is a further object of the present invention to provide a new illuminated signal device which is of a durable and reliable construction.

An even further object of the present invention is to provide a new illuminated signal device which is susceptible of a low cost of manufacture with regard to both materials and labor, and which accordingly is then susceptible of low prices of sale to the consuming public, thereby making such illuminated signal devices economically available to the buying public.

Still yet another object of the present invention is to provide a new illuminated signal device which provides in the apparatuses and methods of the prior art some of the advantages thereof, while simultaneously overcoming some of the disadvantages normally associated therewith.

Still another object of the present invention is to provide a new illuminated signal device for alerting and informing surrounding persons.

Yet another object of the present invention is to provide a new illuminated signal device which includes a hand-held illuminated signal assembly which can be manually manipulated to signal information to passing motorists, and a power supply belt which can be worn by a user and is electrically coupled to the signal assembly to provide electrical power thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
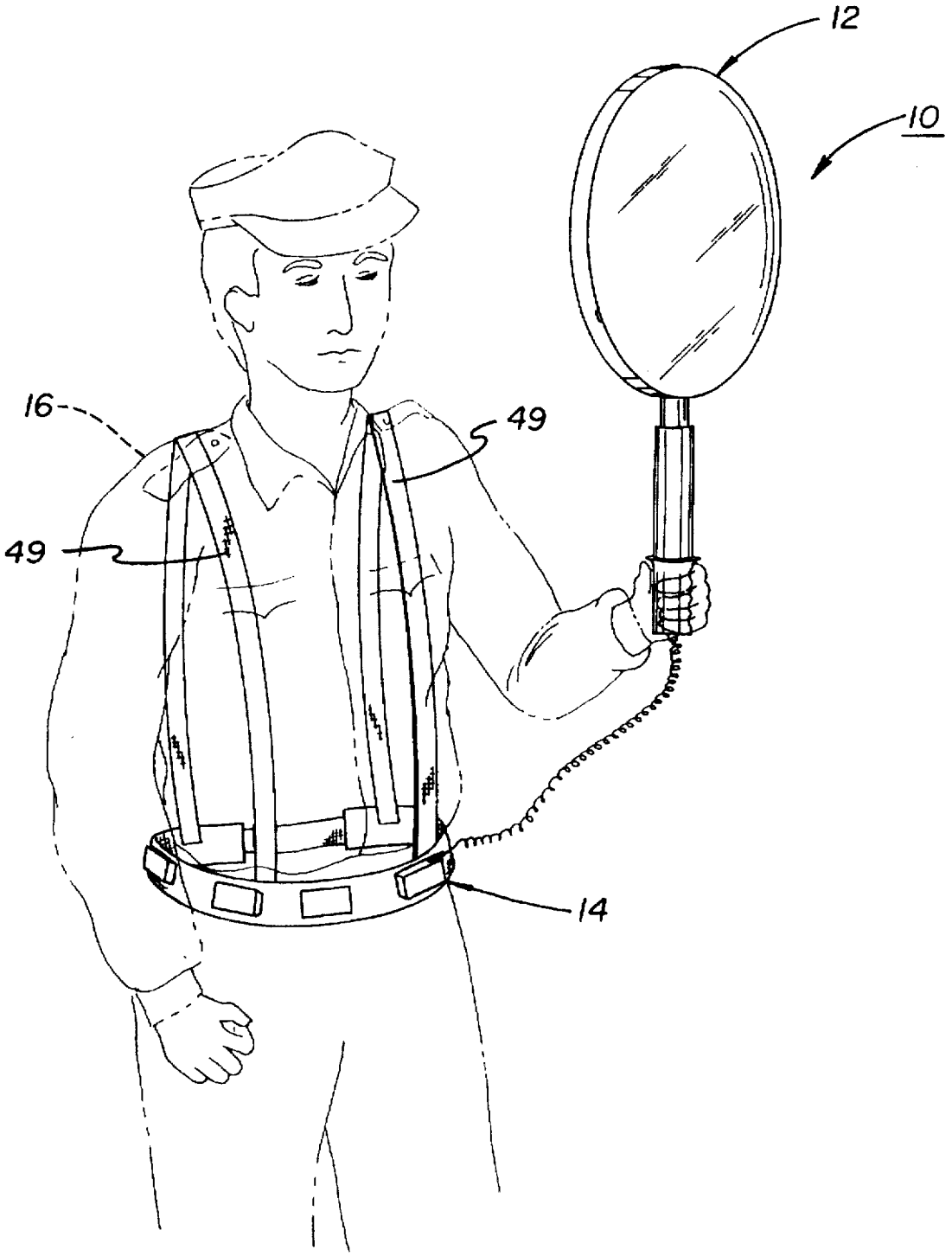
FIG. 1 is an isometric illustration of an illuminated signal device according to the present invention in use.
Figure 2:
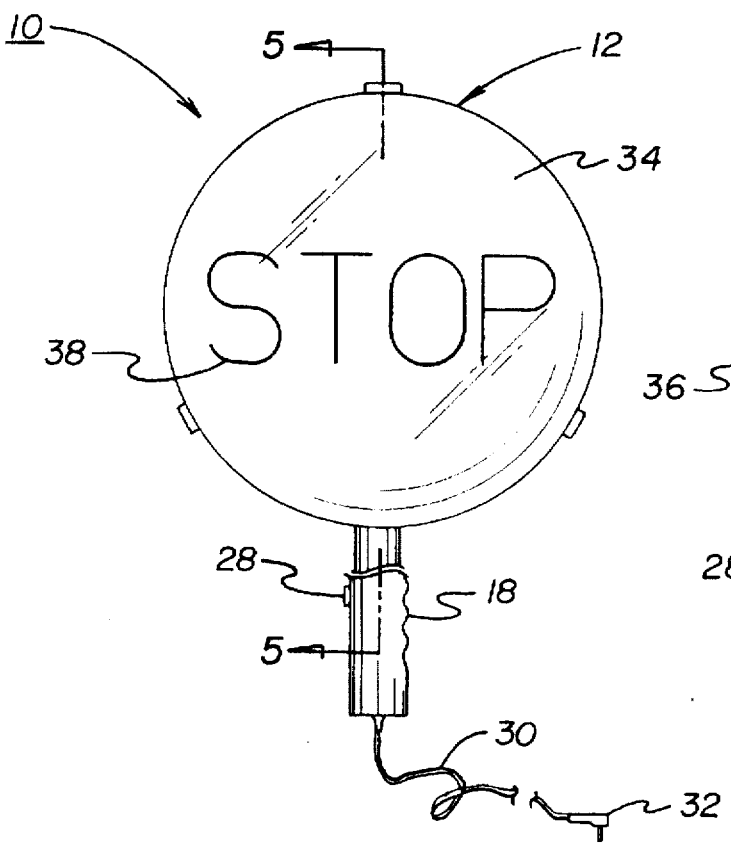
FIG. 2 is a front elevation view of an illuminated signal means of the present invention.
Figure 3:
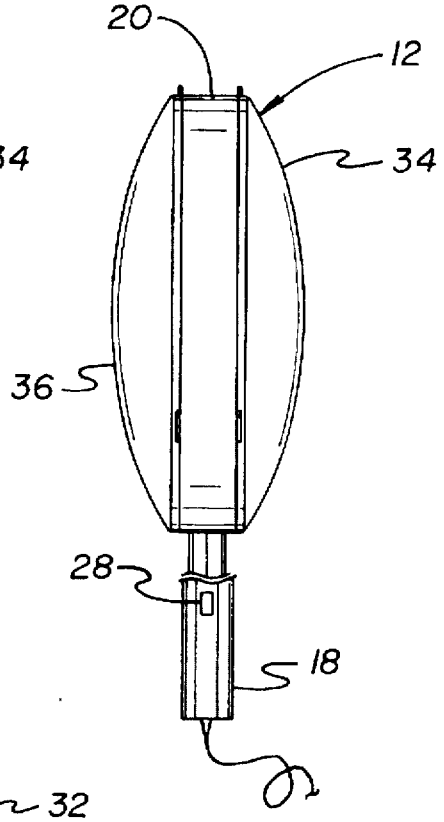
FIG. 3 is a side elevation view of the illuminated signal means.

With reference now to the drawings, and in particular to FIGS. 1–9 thereof, a new illuminated signal device embodying the principles and concepts of the present invention and generally designated by the reference numeral 10 will be described.

More specifically, it will be noted that the illuminated signal device 10 comprises an illuminated signal means 12 for signalling and informing surrounding persons. A power supply means 14 can be worn by an individual 16 during use of the device 10 and is electrically coupled to the illuminated signal means 12 for providing electrical power thereto. By this structure, a crossing guide or like individual 16 can signal information to passing motorists during poor ambient light or adverse weather conditions.

Figure 4:
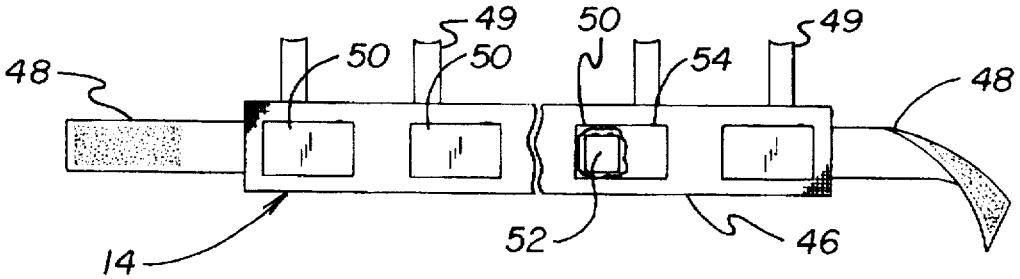
FIG. 4 is an elevation view of a power supply means of the invention.
Figure 5:
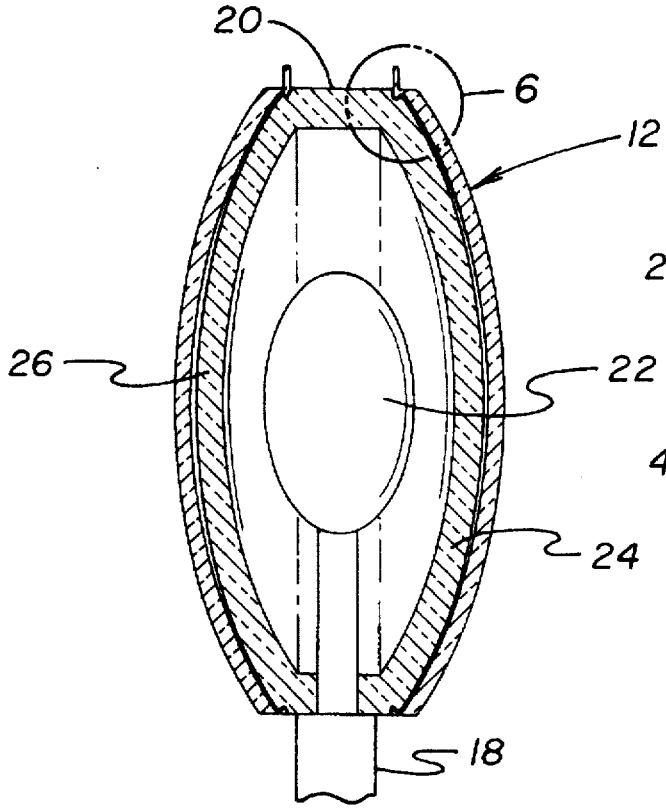
FIG. 5 is a cross-sectional view taken along line 5—5 of FIG. 2.

Referring now to FIGS. 2 through 6 wherein the present invention 10 is illustrated in detail, it can be shown that the illuminated signal means 12 of the present invention 10 preferably comprises a handle 18 adapted to be grasped and manipulated by an individual 16 during use of the device 10. If desired, the handle 18, as shown in the figures, can be configured so as to include a plurality of unlabeled telescoping tubes which can be telescopingly adjusted to extend the handle 18 to a desired length. An outer body 20 of substantially annular configuration extends from an upper end of the handle 18 and supports the light bulb 22 centrally therewithin. As shown in FIG. 5, a front lens 24 extends transversely across the outer body 20 and over the light bulb 22. Similarly, a rear lens 26 extends transversely across the outer body 22 so as to enclose the light bulb 22 between the front and rear lenses 24 and 26 and within the outer body 20. The lenses 24 and 26 are substantially transparent or translucent in construction such that light generated by the light bulb 22 can be radiated therethrough. If desired, the outer body 20 can also be transparent or translucent, but is preferably coated with a substantially opaque material such that light from the light bulb 22 is directed through the lenses 24 and 26. The light bulb 22 is electrically coupled to a front switch 28 mounted within the handle 18 and projecting outwardly therefrom for operation of the front switch 28 by a thumb of an individual 16 holding the device 10 as illustrated in FIG. 1 of the drawings. A power cord 30 extends from electrical communication with the front switch 28 and through the handle 18 to project exteriorly thereof and terminate in an electrical connector 32 which can be electrically coupled to the power supply means 14 so as to provide electrical power necessary for illumination of the light bulb 22.

Figure 6:
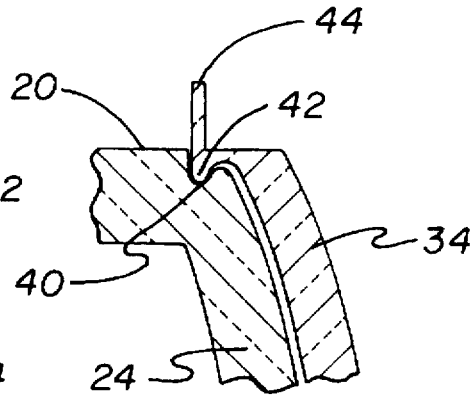
FIG. 6 is a cross-sectional view of the area set forth in FIG. 5.

As best illustrated in FIGS. 5 and 6, it can be shown that the illuminated signal means 12 and the present invention 10 further comprises a front lens modifier 34 removably positioned over the front lens 24, and a rear lens modifier 36 similarly removably positioned over the rear lens 26. The lens modifiers 34 and 36 may each be provided with informational indicia 38 printed thereon which can be read or otherwise interpreted by surrounding individuals such as passing motorists. To removably couple the lens modifiers 34 and 36 to the respective lenses 24 and 26, each of the lenses 24 and 26 is shaped so as to define an annular groove 40 extending circumferentially thereabout. The lens modifiers 34 and 36 are correspondingly shaped so as to define an annular projection 42 extending radially inwardly which can be removably positioned within the annular groove 40 of the respective lens 24 and 26. To permit for ease of installation and/or removal of the lens modifiers 34 and 36 relative to the lenses 24 and 26, the lens modifiers preferably additionally comprise one or more gripping tabs 44 extending therefrom which can be grasped and manipulated by an individual to facilitate installation and separation of the lens modifiers from the lenses 24 and 26.

Referring now to FIG. 4, it can be shown that the power supply means 14 of the present invention 10 preferably comprises a belt 46 adapted to be circumferentially extended about a waist of an individual 16 utilizing the present invention 10. A pair of hook and loop securing straps 48 project from respectively opposed longitudinal ends of the belt 46 and can be cooperatively secured together so as to mount the power supply means 14 about the waist of the individual 16 as shown in FIG. 1 of the drawings. If desired, a pair of shoulder harnesses 49 can extend from the belt 46 for positioning over shoulders of an individual, as shown in FIG. 1 for example. A plurality of battery compartments 50 are secured to an exterior surface of the belt 46 of the power supply means 14 and each include one or more batteries 52 positioned therein. Each battery compartment 50 is provided with a second electrical connector 54 coupled to the respective battery or batteries 52 which can be cooperatively coupled with the electrical connector 52 of the illuminated signal means 12. By this structure, an individual can selectively utilize the battery or batteries 52 within an individual one of the battery compartments 50 by simply plugging the first electrical connector into the second electrical connector 54 of the respective battery compartment 50. Upon exhaustion of the battery or batteries 52 within a particular battery compartment 50, an individual may simply reposition or reconnect the first electrical connector 32 to the second electrical connector 54 of another one of the battery compartments 50. Alternatively, the battery compartments 50 can be electrically coupled together in a parallel electrical orientation such that a single electrical connector 54 is electrically coupled to the battery or batteries 52 within all of the battery compartments 50.

Figure 7:
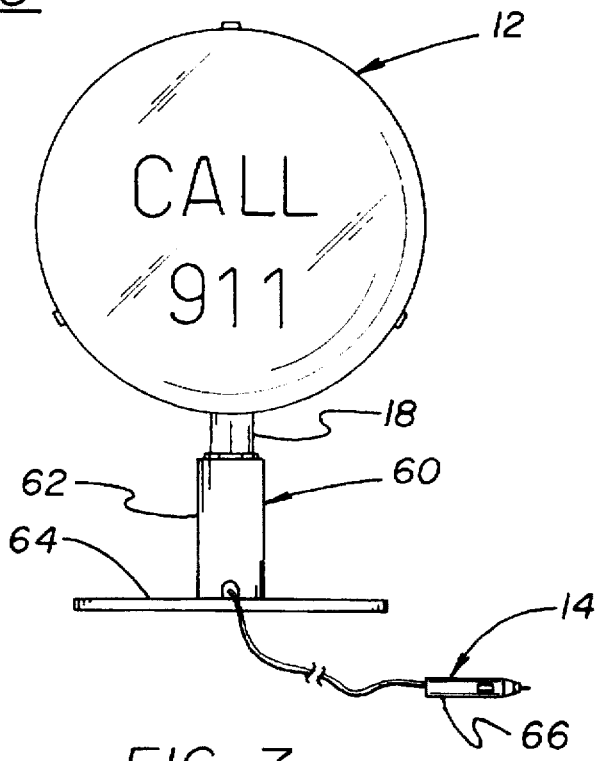
FIG. 7 is an elevation view of the invention including a base support.

Turning now to FIG. 7, it can be shown that the present invention 10 may further comprise a base support 60 for supporting the illuminated signal means 12 in a substantially orthogonal orientation relative to a support surface. To this end, the base support 60 preferably comprises a hollow receiver 62 within which the handle 18 is positioned. A base plate 64 is coupled to a lower end of the receiver 62 and can be positioned upon a support surface so as to support the handle 18 and associated illuminated signal means 12 relative to the support surface. Further, it is within the intent and purview of the present invention for the power supply means 14 to simply comprise a cigarette lighter adaptor 66 electrically coupled to the power cord 30 of the illuminated signal means 12 so as to permit powering of the illuminated signal means 12 from a cigarette lighter of an unillustrated vehicle, with the base support 60 operating to support the illuminated signal means 12 upon a roof or other portion of such vehicle.

Figure 8:
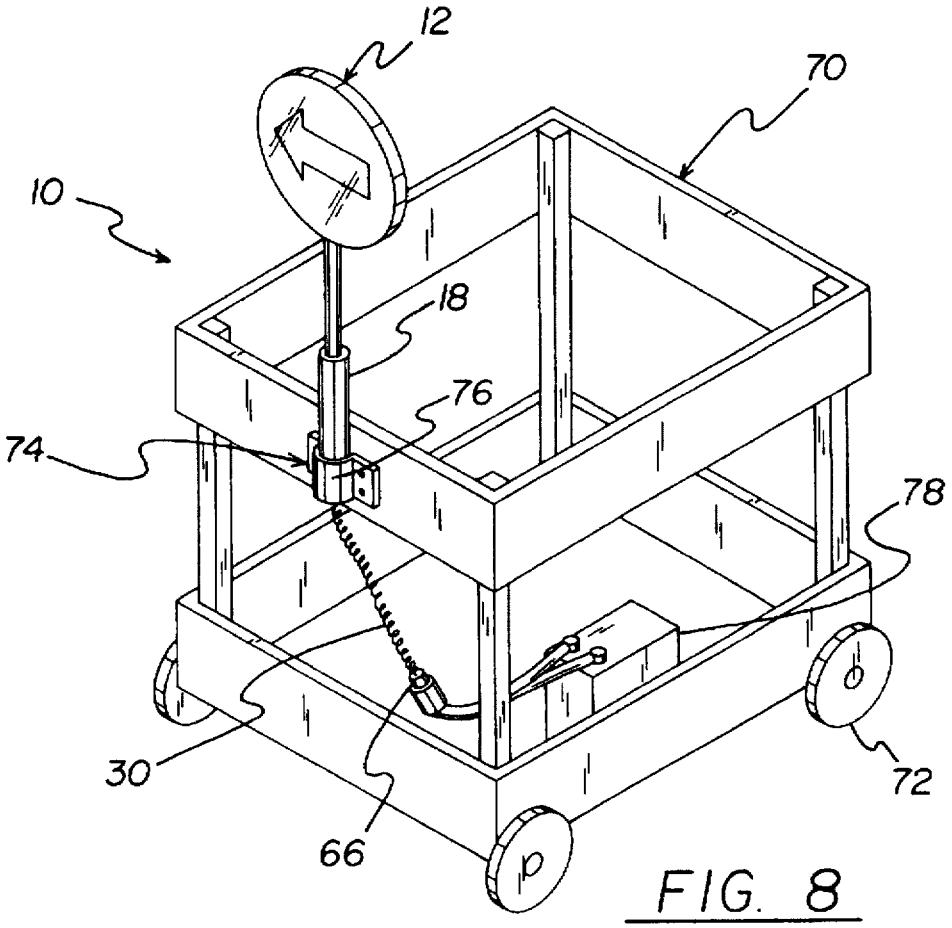
FIG. 8 is an isometric illustration of the invention including a cart having a cart bracket attached thereto.
Figure 9:
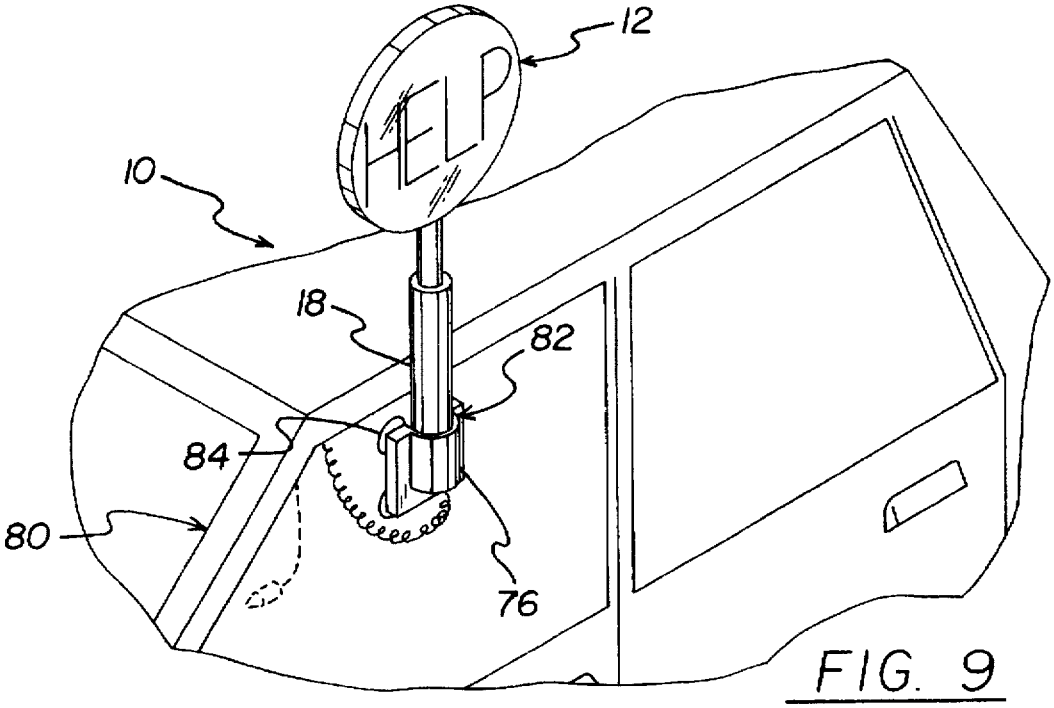
FIG. 9 is an isometric illustration of the invention including a vehicle having a vehicle bracket attached thereto.

Referring to FIG. 8, the invention 10 may be utilized in conjunction with a cart 70 including wheels 72 by way of a cart bracket 74 secured to the cart 70 which supports the sign means 12 relative thereto. To this end, the cart bracket 74 includes a handle receiver 76 which is secured to a side of the cart 70 and receives at least a portion of the handle 18 therein. A battery 78 can be mounted within the cart 70 for electrical coupling with the power cord 30. As shown in FIG. 9, the invention 10 may also be utilized in conjunction with a vehicle 80 by way of a vehicle bracket 82 secured to the vehicle 80 which supports the sign means 12 relative thereto. To this end, the vehicle bracket 82 similarly includes a handle receiver 76 which can secured to a side of the vehicle 80 and receives at least a portion of the handle 18 therein. The vehicle bracket 82 thus preferably includes one or more suction cups 84 which can be pneumatically engaged with a window of the vehicle 80 to secure the vehicle bracket 82 thereto. Alternatively, the vehicle bracket 82 may employ magnets, window edge engaging clips or the like to secure the vehicle bracket 82 relative to any portion of the vehicle 80.

In use, the illuminated signal device 10 of the present invention can be easily utilized for signalling and informing surrounding persons. The present invention 10 is particularly useful by a crossing guard or like individual 16 such as is illustrated in FIG. 1 of the drawings, wherein the illuminated nature of the signal means 12 allows such crossing guard to be seen during poor ambient light conditions or inclement weather conditions.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminated signal device comprising:

an illuminated signal means for signalling and informing surrounding persons; and a power supply means for being worn by an individual, the power supply means being electrically coupled to the illuminated signal means for providing electrical power thereto, the illuminated signal means comprises a handle adapted to be grasped and manipulated by said individual; an outer body extending from an upper end of the handle; a light bulb supported within the outer body; a front lens extending transversely across the outer body and over the light bulb; a rear lens extending transversely across the outer body so as to enclose the light bulb between the front and rear lenses and within the outer body; a power cord positioned in electrical communication with the light bulb and extending through the handle to project exteriorly thereof and terminate in a first electrical connector electrically coupled to the power supply means so as to provide electrical power to the light bulb; the outer body having a substantially annular configuration; the illuminated signal means further comprises a front lens modifier removably positioned over the front lens, and a rear lens modifier removably positioned over the rear lens, the lens modifiers each including informational indicia printed thereon which can be interpreted by surrounding individuals.

2. The illuminated signal device of claim 1, wherein each of the lenses is shaped so as to define an annular groove extending circumferentially thereabout, the lens modifiers being shaped so as to define an annular projection extending radially inwardly which is removably positioned within the annular groove of the respective lens.

3. The illuminated signal device of claim 2, wherein the lens modifiers further comprise at least one gripping tab extending therefrom which can be grasped and manipulated by said individual to facilitate installation and separation of the lens modifiers from the respective lenses.

4. The illuminated signal device of claim 3, wherein the power supply means comprises a belt adapted to be circumferentially extended and secured about a waist of said individual; and a plurality of battery compartments secured to an exterior surface of the belt of the power supply means, each of the battery compartments including a battery positioned therein, with each battery compartment including a second electrical connector coupled to the respective battery which can be cooperatively coupled with the first electrical connector of the illuminated signal means.

5. The illuminated signal device of claim 4, wherein the battery compartments are electrically coupled together in a parallel electrical orientation.

6. The illuminated signal device of claim 4, wherein the battery compartments are not electrically coupled together such that said individual can selectively utilize the battery within an individual one of the battery compartments by simply plugging the first electrical connector into the second electrical connector of the respective battery compartment, whereby upon exhaustion of the battery within a particular one of the battery compartments, an individual can reconnect the first electrical connector to the second electrical connector of another one of the battery compartments.

* * * * *